US005591050A

United States Patent [19]

Sueoka

[11] Patent Number: 5,591,050

[45] Date of Patent: Jan. 7, 1997

[54] SHIELDED ELECTRICAL CONNECTOR

[75] Inventor: Satoshi Sueoka, Yamato, Japan

[73] Assignee: Molex Incorporated, Lisle, Ill.

[21] Appl. No.: 386,031

[22] Filed: Feb. 9, 1995

[51] Int. Cl.[6] ..... H01R 13/00

[52] U.S. Cl. ..... 439/607

[58] Field of Search ..... 439/92, 101, 108, 439/607, 608, 609, 361, 362

[56] References Cited

U.S. PATENT DOCUMENTS

| | | | |
|---|---|---|---|
| 4,512,618 | 4/1985 | Kumar | 439/607 |
| 4,518,209 | 5/1985 | Negley | 439/607 |
| 4,628,410 | 12/1986 | Goodman et al. | 361/413 |
| 4,629,278 | 12/1986 | Norton et al. . | |
| 4,938,704 | 7/1990 | Fujiura | 439/95 |
| 5,104,326 | 4/1992 | Smith et al. | 439/607 |
| 5,281,169 | 1/1994 | Kiat et al. | 439/607 |
| 5,304,069 | 4/1994 | Brunker et al. | 439/608 |

FOREIGN PATENT DOCUMENTS

| | | | |
|---|---|---|---|
| 6176808 | 6/1994 | Japan | H01R 9/09 |
| 654244 | 7/1994 | Japan | H01R 13/46 |

*Primary Examiner*—Hien Vu
*Attorney, Agent, or Firm*—Charles S. Cohen

[57] ABSTRACT

A shielded surface mount electrical connector includes an elongated dielectric housing having a front mating face and a rear terminating face with a plurality of terminal-receiving passages extending generally between the faces. The housing is adapted for surface mounting to a printed circuit board and includes a mating portion projecting forwardly of the mating face. A plurality of terminals are received in the cavities. A metallic shield covers a substantial portion of the dielectric housing and includes at least one wall projecting rearwardly of the terminating face of the housing for shifting the center of gravity of the connector rearwardly. The wall has a surface mount foot for connection to an appropriate pad on the printed circuit board.

9 Claims, 2 Drawing Sheets

SHIELDED ELECTRICAL CONNECTOR

FIELD OF THE INVENTION

This invention generally relates to the art of electrical connectors and, particularly, to a shielded electrical connector for surface mounting on a printed circuit board.

BACKGROUND OF THE INVENTION

A conventional shielded surface mount electrical connector includes a dielectric (plastic) housing having a plurality of terminal-receiving cavities or passages, with a plurality of terminals received in the passages. A metal shield surrounds a substantial portion of the housing to protect at least the mating portions of the terminals from RF and EMI interference as well as protecting the surroundings from interference radiating from the connector, itself. The housing is mounted to the surface of a printed circuit board, and the terminals have tail portions for surface mounting to circuit pads on the board. In some applications, the housing has no mounting feet or boardlocks extending into holes in the printed circuit board to secure it to the board.

Prior art shielded input/output (I/O) connectors typically have had problems in being relatively unbalanced because the plastic housing often has a forwardly extending mating portion in which contact portions of the terminals are positioned. For instance, one type of forwardly extending projection is generally D-shaped. This D-shaped projection is surrounded by the metal shield which causes the center or gravity of the connector to be forward and results in the connector being somewhat unbalanced or unstable. When the connectors are used in through-hole applications, boardlocks typically extend from the housing through and into holes in the printed circuit board. In these through-hole applications, the problem of the connector being "front-heavy" is not a significant factor because the boardlocks hold the connector in place. However, in surface mount applications as described above, it is desirable to eliminate holes in the printed circuit board and avoid use of boardlocks. In these surface mount applications, the front-heavy connector causes problems since it may tip forwardly after placement onto the printed circuit board but before permanent soldering thereto. Consequently, efforts must be made to hold the connector in proper surface-mounted position on the board during soldering or else use boardlocks.

The present invention is directed to solving the above problems and providing an electrical connector which is more balanced and stable than connectors heretofore available to maintain the connector in a balanced or stable surface mount position on a circuit board prior to and during permanent processing of the connector onto the board.

SUMMARY OF THE INVENTION

An object, therefore, of the invention is to provide a new and improved shielded surface mount electrical connector of the character described.

In the exemplary embodiment of the invention, the connector includes an elongated dielectric housing having a front mating face and a rear terminating face, with a plurality of terminal-receiving passages extending generally between the faces. The housing is adapted for surface mounting to a printed circuit board and includes a mating portion projecting forwardly of the mating face. A plurality of terminals are received in the cavities. A metallic shield covers a substantial portion of the dielectric housing and includes at least one wall projecting rearwardly of the terminating face of the housing for shifting the center of gravity of the connector rearwardly. The wall, thereby, balances the housing in a front-to-rear direction.

As disclosed herein, one of the rearwardly projecting walls is provided generally at each opposite end of the elongated housing. The walls are generally planar and extend in substantially front-to-rear planes. A planar surface mount foot extends generally perpendicular to each planar wall for connection to a pad on the printed circuit board. The feet have apertures for passing therethrough of solder material during a soldering process to connect the feet to their respective pads on the board. The entire shield, including the rearwardly projecting walls and the surface mount feet, comprises an integral structure stamped and formed of sheet metal material, with the feet being integral with bottom edges of the walls.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
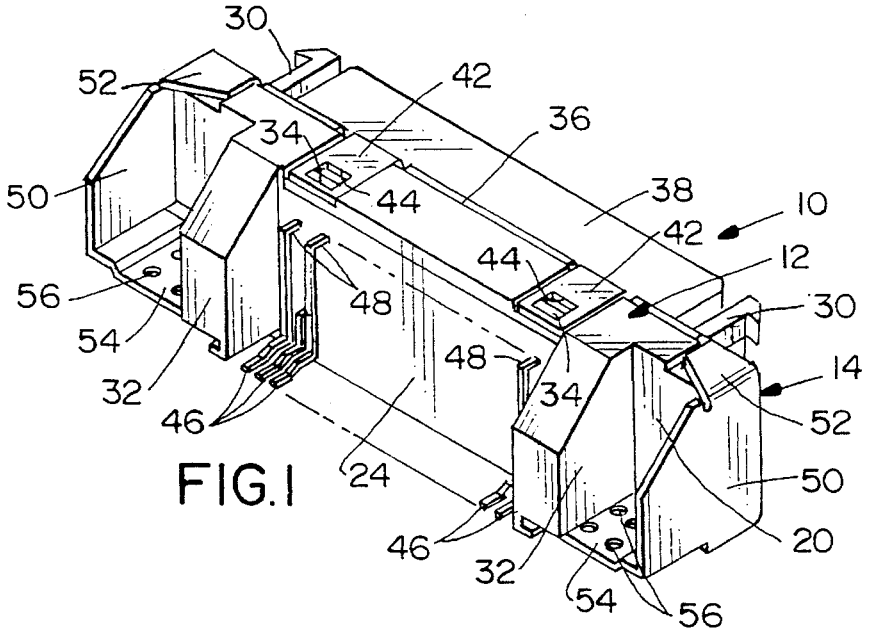
FIG. 1 is a perspective view looking toward the rear of a shielded surface mount electrical connector incorporating the concepts of the invention.

Referring to the drawings in greater detail, the invention is embodied in a shielded surface mount electrical connector, generally designated 10. In other words, the connector is adapted for mounting on a top surface of a printed circuit board, with no boardlock projections or terminal tails extending into holes in the printed circuit board.

Figure 2:
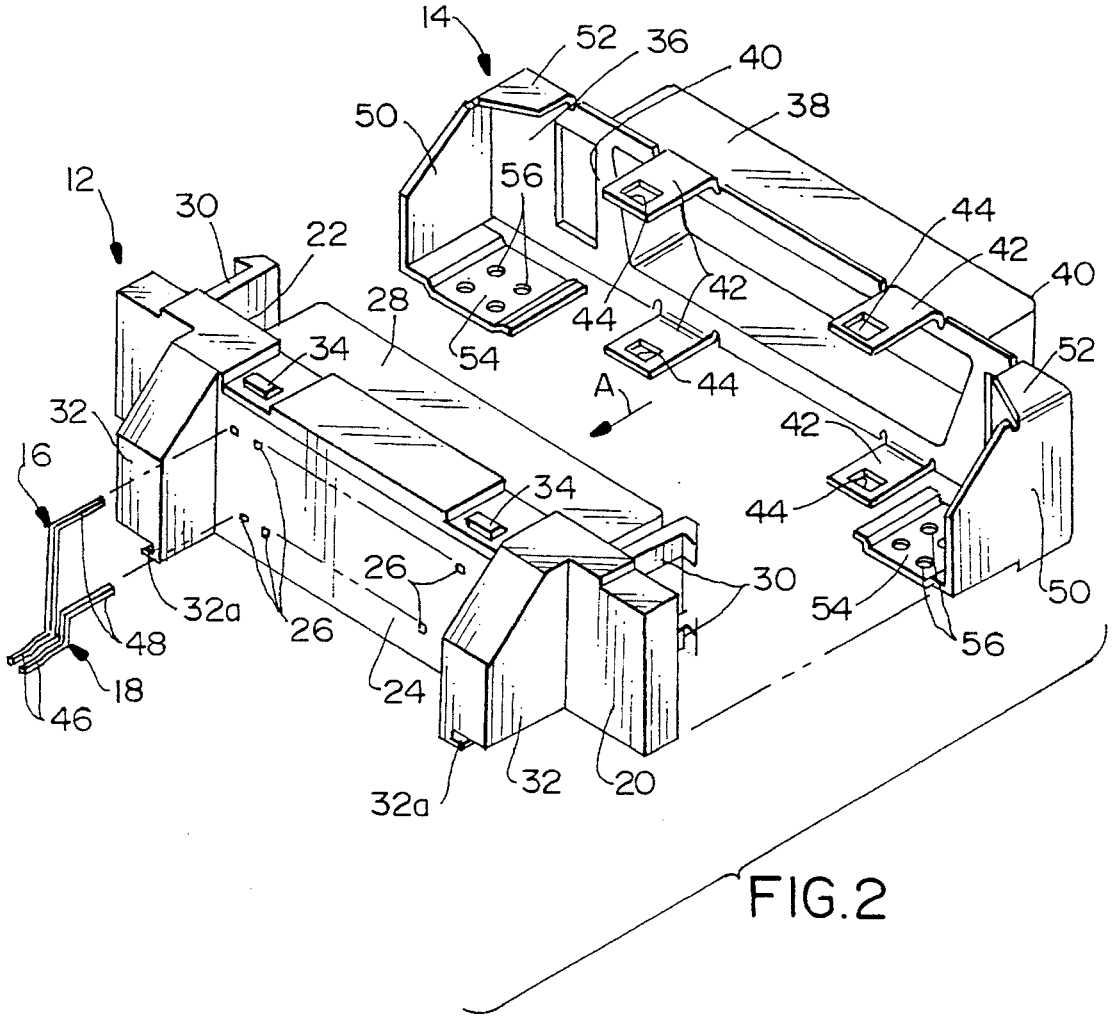
FIG. 2 is a view similar to that of FIG. 1, but with the components of the connector exploded to facilitate the illustration.
Figure 3:
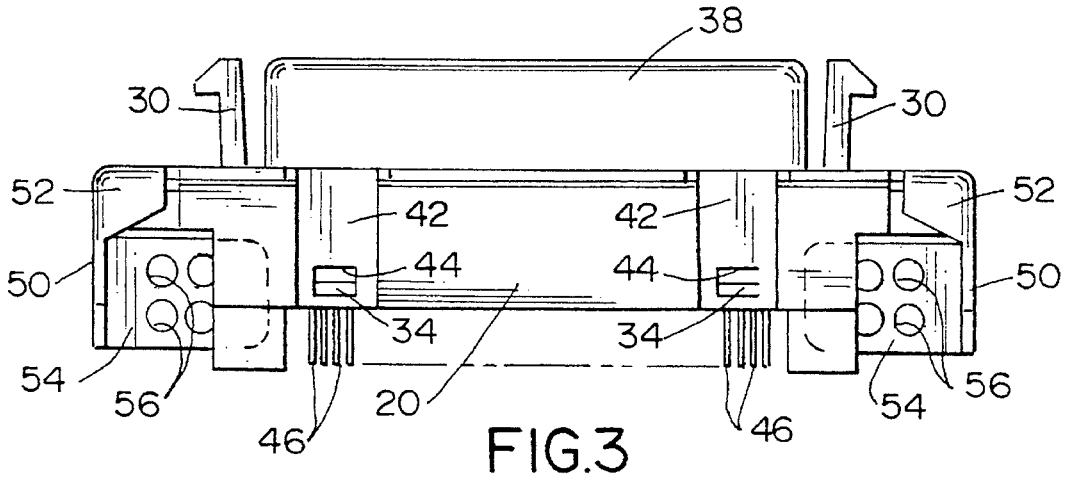
FIG. 3 is a top plan view of the connector.

As best seen in FIG. 2, connector 10 includes two primary components, namely an elongated dielectric housing, generally designated 10, and a unitary shield, generally designated 14, along with a plurality of terminals, generally designated 16 and 18. The housing is a unitary structure integrally molded of dielectric material such as plastic or the like. The shield is a unitary structure stamped and formed of sheet metal material.

Figure 4:
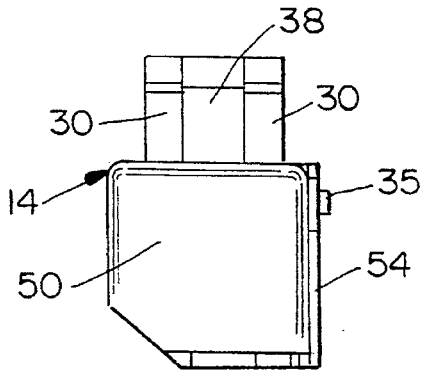
FIG. 4 is an end elevational view of the connector.
Figure 5:
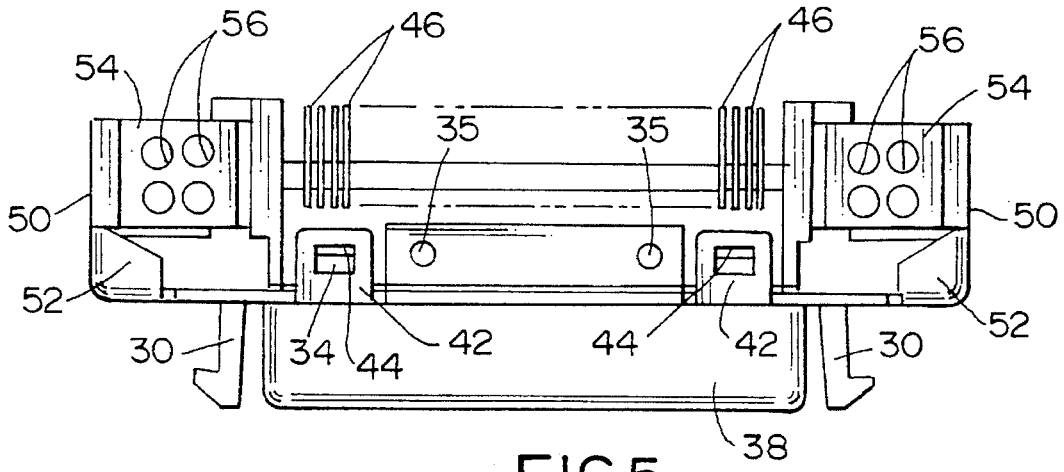
FIG. 5 is a bottom plan view of the connector.

More particularly, dielectric housing 12 includes a body portion in the form of a flange 20 having a front mating face 22 and a rear terminating face 24. A plurality of terminal-receiving passages 26 (FIG. 2) extend generally between the faces. A mating D-shaped portion 28 projects forwardly of mating face 22. A plurality of latch arms 30 also project forwardly of the mating face for interengagement with complementary latch means on a mating connector (not shown). In the alternative, separate latch arms (not shown)

formed of metal or some other durable material could be mounted to the housing. A pair of gussets 32 project rearwardly of terminating face 24 and include lower stabilizing notches 32*a* for receiving a surface mount foot 54 as described below. Lastly, a pair of latch bosses 34 project upwardly from both the top and bottom of body 20 for latching the shield to the body, as described hereinafter. If desired, one or more locating pegs 35 (FIGS. 4 and 5) may extend from housing 12 for fitting within holes in a printed circuit board (not shown) on which the connector is mounted to assist in accurately positioning the connector.

As stated above, shield 14 is a unitary structure stamped and formed of sheet metal material. The shield includes a main flange 36 that abuts against front mating face 22 of housing 12. A generally D-shaped shroud portion 38 projects forwardly of flange 36 and surrounds mating portion 28 of the housing and the contact portions of the terminals therewithin. Holes 40 are formed in flange 36 for passing therethrough of latch arms 30 of the housing. Latch tabs 42 project rearwardly of flange 36 at the top and bottom edges thereof and include apertures 44 for snappingly interengaging with latch bosses 34 of the housing when the shield is assembled to the housing in the direction of arrow "A" (FIG. 2).

Terminals 16 and 18 include surface mount tails 46 for connection, as by soldering, to circuit traces on the top surface of the printed circuit board. In other words, the terminals do not have any solder tails projecting into holes in the printed circuit board. The terminals have contact portions 48 (shown generally schematically in FIG. 2) which project forwardly through passages 26 in housing 12 and into the forwardly projecting portion 28 of the housing, with shroud portion 38 of the shield surrounding the contact portions of the terminals within the forwardly projecting portion of the housing.

With the above description of connector 10 to this point, it can be understood that the connector (without the invention described hereinafter) would be quite "front-heavy" because of the forwardly projecting portion 28 of housing 12 and the surrounding, forwardly projecting shroud portion 38 of shield 14. In other words, the connector (without the invention) would tend to tip forwardly and raise tail portions 46 of the terminals off of the pads on the printed circuit board to which the tail portions are to be soldered. This would be highly undesirable during processing of the connector. Even if the tail portions were lifted only slightly off of their pads on the circuit board during soldering, a defective electrical connection could occur.

To solve these problems, the invention contemplates providing at least one rather massive wall 50 projecting rearwardly of terminating face 24 of housing 12 for shifting the center of gravity of the connector rearwardly and, thereby, balance the housing in a front-to-rear direction. In the preferred embodiment of the invention, it can be seen that two rearwardly projecting walls 50 are provided, one at each opposite end of shield 14 to extend rearwardly beyond each opposite end of housing 12. The walls are joined integrally with and extend rearwardly from opposite ends of main flange 36 of the shield. Supporting gussets 52 join the walls with the main flange at the top and bottom of the flange to rigidify the walls and establish an outer envelope of the shield that engages the outer upper and lower surfaces of housing flange 20 to accurately position and secure the shield in place.

The invention further contemplates that a surface mount foot 54 be provided at the bottom edge of each wall 50 for connection (as by soldering) to a pad on the printed circuit board. It can be seen that the feet project inwardly toward each other from the bottom edges of walls 50 and are preferably secured within stabilizing notches 32*a* to accurately position the feet.

Surface mount feet 54 include apertures 56 therethrough. These apertures allow for solder paste material to pass upwardly therethrough to assist in retaining the surface mount feet both before and after soldering. In addition, these plurality of holes increase the heat that is transmitted to the solder paste material under the surface of feet 54 in order to ensure complete melting of the solder paste material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A shielded surface mount electrical connector for mounting to a surface of a circuit board, comprising:

an elongated dielectric housing having a generally vertical front face and a rear face, the housing being adapted for mounting to the surface of said circuit board and including a mating portion projecting forwardly of the front face, said mating portion including a top, bottom and two side surfaces and, a plurality of terminal-receiving cavities extending between said mating portion and said rear face;

a plurality of terminals received in said cavities, each said terminal including a contact portion for mating with a complementary mating component, and a tail portion for soldering to the surface of said circuit board; and a metallic shield including a generally planar front flange with a projection therefrom surrounding the top, bottom and two side surfaces of the mating portion of the dielectric housing and including a pair of generally planar walls, each of said walls being positioned at opposite side ends of the housing, each of the walls projecting rearwardly substantially to a rear extremity of the housing and having a height substantially the same as the height of the housing, each of said walls being positioned generally perpendicularly to said front flange and including a generally planar surface mounting foot extending from each of said walls for connection to an appropriate pad on the circuit board, wherein said surface mounting feet extend toward each other and are generally perpendicular to said generally planar walls, the walls and feet being of sufficient mass to shift a center of gravity of the connector rearwardly and, thereby, facilitate balancing the housing in a front-to-rear direction, and a rigidify gusset extending generally perpendicularly from a top surface of each wall to rigidify the respective wall.

2. The shielded surface mount electrical connector of claim 1 wherein each said foot includes at least one aperture for passing therethrough of solder paste material.

3. The shielded surface mount electrical connector of claim 1 wherein an end of each said surface mounting foot has an upwards step and said step is positioned within a recess in said housing.

4. The shielded surface mount electrical connector of claim 1 wherein each said surface mounting foot extends form a bottom edge of said well.

5. The shielded surface mount electrical connector of claim 4 wherein an end of each said surface mounting foot has an upwards step and said step is positioned within a recess in said housing.

6. The shielded surface mount electrical connector of claim 4 wherein each said foot includes a plurality of apertures for passing therethrough of solder material during a soldering process to connect the foot to said pad.

7. A shielded surface mount electrical connector for mounting to a surface of a circuit board, comprising:

an elongated dielectric housing having a body portion with opposite side ends, a mating portion projecting forwardly of the body portion, said mating portion including a top, bottom and two side surfaces, a plurality of terminal-receiving cavities extending through said body portion, and a pair of spaced apart projections extending rearwardly form said body portion, each of said projections being spaced inwardly from one of said opposite side ends of said body portion and extending substantially from a bottom surface of said body portion to a top surface of said body portion;

a plurality of terminals received in said cavities, said terminals including a contact portion for mating with a complementary mating connector and a tail portion for surface mount soldering to circuit traces on the surface of said circuit board, said tail portions extending rearwardly form said body portion and tips of said tail portions being generally aligned with a rearward face of said spaced apart rearwardly extending projections; and a metallic shield mounted to the housing an including a projection surrounding the top, bottom and two side surfaces of the forwardly projecting mating portion of the housing, the shield including a pair of generally planar walls projecting substantially to a rear extremity of the housing, each of said walls being positioned at each of said opposite side ends, each of said walls including a generally planar surface mounting foot at the bottom thereof and extending generally perpendicularly thereto for connection to an appropriate pad on the circuit board, each of said surface mounting feet extending inwardly towards an adjacent one of said spaced apart rearwardly extending projections, and each of said walls has a height substantially the same as the height of the housing, the walls and surface mounting feet being of a sufficient mass to shift the center of gravity of the connector rearwardly and, thereby, facilitating balancing the housing in a front-to-rear direction.

8. The shielded surface mount electrical connector of claim 7 wherein said surface mounting feet are integral with bottom edges of the respective walls, and an end of each of said surface mounting feet has an upwards step and said step is positioned within a recess in one of said spaced apart rearwardly extending projections of said housing.

9. The shielded surface mount electrical connector of claim 7 wherein each of said feet includes a plurality of apertures for passing therethrough of solder material during a soldering process to connect the feet to said pads.

* * * * *